US010115339B2

(12) United States Patent
Gupta et al.

(10) Patent No.: US 10,115,339 B2
(45) Date of Patent: Oct. 30, 2018

(54) ORGANIC LIGHT-EMITTING DIODE DISPLAY WITH GATE PULSE MODULATION

(71) Applicant: Apple Inc., Cupertino, CA (US)

(72) Inventors: Vasudha Gupta, Cupertino, CA (US); Chin-Wei Lin, Cupertino, CA (US); Tsung-Ting Tsai, Taipei (TW)

(73) Assignee: Apple Inc., Cupertino, CA (US)

( * ) Notice: Subject to any disclaimer, the term of this patent is extended or adjusted under 35 U.S.C. 154(b) by 128 days.

(21) Appl. No.: 14/850,111

(22) Filed: Sep. 10, 2015

(65) Prior Publication Data

US 2016/0284276 A1 Sep. 29, 2016

Related U.S. Application Data

(60) Provisional application No. 62/139,469, filed on Mar. 27, 2015.

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/3208* (2013.01); *G09G 3/3225* (2013.01);
(Continued)

(58) Field of Classification Search
CPC ..... G09G 3/3233; G09G 2300/0819; G09G 2300/043; G09G 2300/0861; G09G 2300/0866; G09G 2320/0233; G09G 2320/043; G09G 2320/045; G09G 2320/0252; G09G 2310/06; G09G 2310/066; G09G 3/3225; G09G 3/3266; G09G 3/3208; G09G 3/3648; G09G 3/3688; G09G 3/3677; G09G 3/3611;
(Continued)

(56) References Cited

U.S. PATENT DOCUMENTS 6,188,375 B1 * 2/2001 Kagey ..... G09G 3/2011 345/76
7,812,793 B2 * 10/2010 Steer ..... G09G 3/3258 345/76

(Continued)

*Primary Examiner* — Dismery Mercedes
(74) *Attorney, Agent, or Firm* — Treyz Law Group, P.C.; G. Victor Treyz; Jason Tsai

(57) ABSTRACT

Display driver circuitry may load data into an array of pixels via data lines. The display driver circuitry may supply control signals including scan signals to the pixels via control lines. Each pixel may have transistors and capacitor circuitry for controlling the emission of light from a light-emitting diode. A drive transistor may be coupled in series with the light-emitting diode to control the amount of current flowing through the light-emitting diode. The drive transistor may have a drive transistor gate terminal that is coupled to one of the source-drain terminals of a switching transistor. The switching transistor may have a switching transistor gate terminal that receives the scan signal. When transitioning prior to an emission phase of operation, the scan signal may have a two-step transition profile or other shape that enhances display performance by reducing dynamic effects in the switching transistor.

23 Claims, 6 Drawing Sheets

(51) Int. Cl.
*G09G 3/3208* (2016.01)
*G09G 3/3225* (2016.01)
*G09G 3/3266* (2016.01)

(52) U.S. Cl.
CPC ... *G09G 3/3266* (2013.01); *G09G 2300/0819* (2013.01); *G09G 2310/0262* (2013.01); *G09G 2310/066* (2013.01); *G09G 2310/067* (2013.01); *G09G 2320/0233* (2013.01)

(58) Field of Classification Search
CPC ..... G09G 2310/08; G09G 2310/067; G09G 2010/0262; G09G 2320/02; G09G 2320/0626; G09G 2320/252; G09G 5/18; G06F 3/044; G06F 3/0412; G06F 3/0416; G06F 3/038
See application file for complete search history.

(56) References Cited

U.S. PATENT DOCUMENTS 8,063,858 B2 * 11/2011 Ishizuka ..... G09G 3/3258 345/204
8,089,429 B2 * 1/2012 Yamashita ..... G09G 3/3233 315/169.1
8,217,879 B2 7/2012 Chiang et al.
8,325,109 B2 * 12/2012 Yamashita ..... G09G 3/3233 345/55
8,421,728 B2 * 4/2013 Takatori ..... G09G 3/3655 345/94
8,928,640 B2 1/2015 Chang et al.
9,024,913 B1 * 5/2015 Jung ..... G06F 3/044 178/18.06
9,159,257 B2 * 10/2015 Kim ..... G09G 3/003
9,646,532 B2 * 5/2017 Onoyama ..... G09G 3/3233
9,747,834 B2 * 8/2017 Chaji ..... G09G 3/3233
9,934,718 B2 * 4/2018 Eun ..... G09G 3/003
2004/0100203 A1 * 5/2004 Kobayashi ..... G09G 3/3233 315/169.3
2005/0057447 A1 * 3/2005 Son ..... G09G 3/2927 345/60
2006/0022305 A1 * 2/2006 Yamashita ..... G09G 3/2014 257/565
2007/0013616 A1 * 1/2007 Jung ..... G09G 3/2927 345/67
2007/0040772 A1 * 2/2007 Kim ..... G09G 3/3233 345/76
2007/0115225 A1 * 5/2007 Uchino ..... G09G 3/3233 345/76
2009/0273550 A1 * 11/2009 Vieri ..... G09G 3/3648 345/87
2010/0289830 A1 * 11/2010 Yamamoto ..... G09G 3/3233 345/690
2012/0299978 A1 * 11/2012 Chaji ..... G09G 3/3291 345/690
2013/0083000 A1 * 4/2013 Toyomura ..... G09G 3/3233 345/212
2013/0088470 A1 * 4/2013 Chang ..... G09G 3/3655 345/208
2013/0100173 A1 * 4/2013 Chaji ..... G09G 5/10 345/690
2014/0055326 A1 * 2/2014 Lai ..... G09G 3/3233 345/77
2015/0062195 A1 * 3/2015 Kumeta ..... G09G 3/3233 345/690
2015/0145819 A1 5/2015 Bae
2015/0179102 A1 * 6/2015 Kim ..... G09G 3/3233 345/77
2015/0187268 A1 7/2015 Tani et al.
2015/0245018 A1 * 8/2015 Park ..... H04N 13/0438 348/53
2016/0133185 A1 * 5/2016 Yoon ..... G09G 3/3233 345/76

* cited by examiner

ORGANIC LIGHT-EMITTING DIODE DISPLAY WITH GATE PULSE MODULATION

This application claims the benefit of provisional patent application No. 62/139,469 filed on Mar. 27, 2015, which is hereby incorporated by reference herein in its entirety.

BACKGROUND

This relates generally to electronic devices with displays, and, more particularly, to organic light-emitting diode displays.

Electronic devices often include displays. Displays such as organic light-emitting diode displays have pixels with light-emitting diodes. Each pixel includes a drive transistor for controlling the light-emitting diode of the pixel. Each pixel also includes one or more switching transistors for performing functions such as initialization, drive transistor threshold voltage compensation, and data loading.

It can be challenging to accurately control the performance of organic light-emitting diode pixels. Drive transistor threshold voltage compensation schemes compensate for threshold variations in the drive transistors, but do not compensate for variations in switching transistors. Dynamic effects for a switching transistor such as clock feedthrough and charge injection can reduce the voltage at the gate of a drive transistor that is coupled to the switching transistor during switching. As a result, pixel brightness range may be reduced and the drive transistor current may be sensitive to variations in switching transistor device parameters.

It would therefore be desirable to be able to provide improved displays such as organic light-emitting diode displays.

SUMMARY

A display may have an array of pixels arranged in rows and columns. Display driver circuitry may load data into the pixels via data lines that extend along the columns. The display driver circuitry may supply control signals including scan signals to the pixels via horizontal control lines.

Each pixel may have transistors and capacitor circuitry for controlling the emission of light from a light-emitting diode. A drive transistor may be coupled in series with the light-emitting diode to control the amount of current flowing through the light-emitting diode. The drive transistor may have a drive transistor gate terminal that is coupled to one of the source-drain terminals of a switching transistor. The switching transistor may have a switching transistor gate terminal that receives a scan signal.

The scan signal that is supplied to the switching transistor may transition between a first voltage and a second voltage when transitioning a pixel between a pre-emission phase of operation in which the light-emitting diode of the pixel does not emit light and an emission phase of operation in which the light-emitting diode emits light. During this transition, the scan signal may have a two-step profile or other shape that reduces dynamic effects in the switching transistor such as clock feedthrough and charge injection. The reduction in these dynamic effects may increase the current and brightness range of the display, may enhance display uniformity by reducing the sensitivity of the pixels to variations in the characteristics of the switching transistors, and may enhance display uniformity by reducing sensitivity of display performance to variations in the threshold voltage of the switching transistors with time.

DETAILED DESCRIPTION

Figure 1:
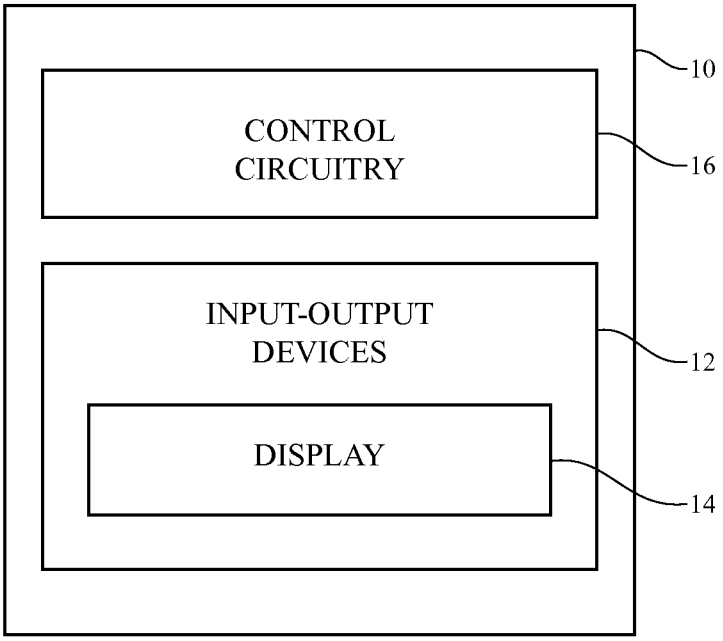
FIG. 1 is a schematic diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory) etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Device 10 may be a tablet computer, laptop computer, a desktop computer, a display, a cellular telephone, a media player, a wristwatch device or other wearable electronic equipment, or other suitable electronic device.

Display 14 may be an organic light-emitting diode display or may be a display based on other types of display technology. Configurations in which display 14 is an organic light-emitting diode display are sometimes described herein as an example. This is, however, merely illustrative. Any suitable type of display may be used in device 10, if desired.

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
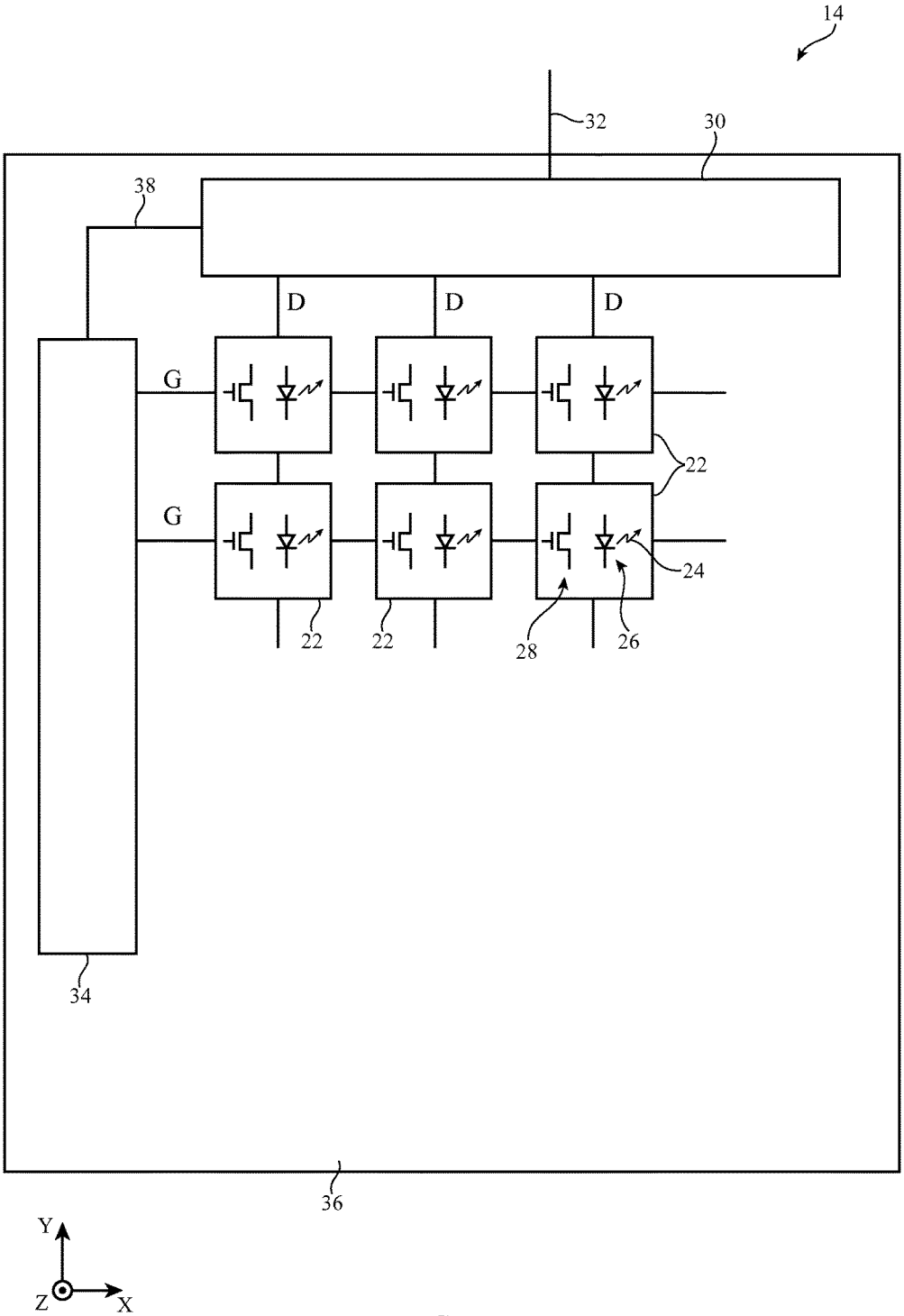
FIG. 2 is a top view of an illustrative display in an electronic device in accordance with an embodiment.

A top view of a portion of display 14 is shown in FIG. 2. As shown in FIG. 2, display 14 may have an array of pixels 22 formed on substrate 36. Substrate 36 may be formed from glass, metal, plastic, ceramic, or other substrate materials. Pixels 22 may receive power supply signals, control signals, and data signals over signal paths formed from vertical and horizontal conductive lines. For example, pixels 22 may receive data signals over vertical signal paths such as data lines D and may receive one or more control signals over horizontal control signal paths such as horizontal control lines G (e.g., scan signals, emission control signals, and other control signals).

There may be any suitable number of rows and columns of pixels 22 in display 14 (e.g., tens or more, hundreds or more, or thousands or more). Each pixel 22 may have a light-emitting diode 26 that emits light 24 under the control of a pixel control circuit formed from transistor circuitry such as thin-film transistors 28 and thin-film capacitors). Thin-film transistors 28 may be polysilicon thin-film transistors, semiconducting-oxide thin-film transistors such as indium zinc gallium oxide transistors, organic semiconductor transistors, or thin-film transistors formed from other semiconductors. Pixels 22 may contain light-emitting diodes of different colors (e.g., red, green, and blue) to provide display 14 with the ability to display color images.

Display driver circuitry may be used to control the operation of pixels 22. The display driver circuitry may be formed from integrated circuits, thin-film transistor circuits, or other suitable circuitry. Display driver circuitry 30 of FIG. 2 may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply circuitry 30 with information on images to be displayed on display 14.

To display the images on display pixels 22, display driver circuitry 30 may supply image data to data lines D (e.g., data lines that run down the columns of pixels 22) while issuing clock signals and other control signals to supporting display driver circuitry such as gate driver circuitry 34 over path 38. If desired, circuitry 30 may also supply clock signals and other control signals to gate driver circuitry on an opposing edge of display 14.

Gate driver circuitry 34 (sometimes referred to as horizontal control line control circuitry or display driver circuitry) may be implemented as part of an integrated circuit and/or may be implemented using thin-film transistor circuitry. Horizontal control lines G in display 14 may carry scan signals, emission enable control signals, and other horizontal control signals (sometimes referred to as gate signals) for controlling the pixels of each row. There may be any suitable number of horizontal control signals per row of pixels 22 (e.g., one or more, two or more, three or more, four or more, etc.).

Figure 3:
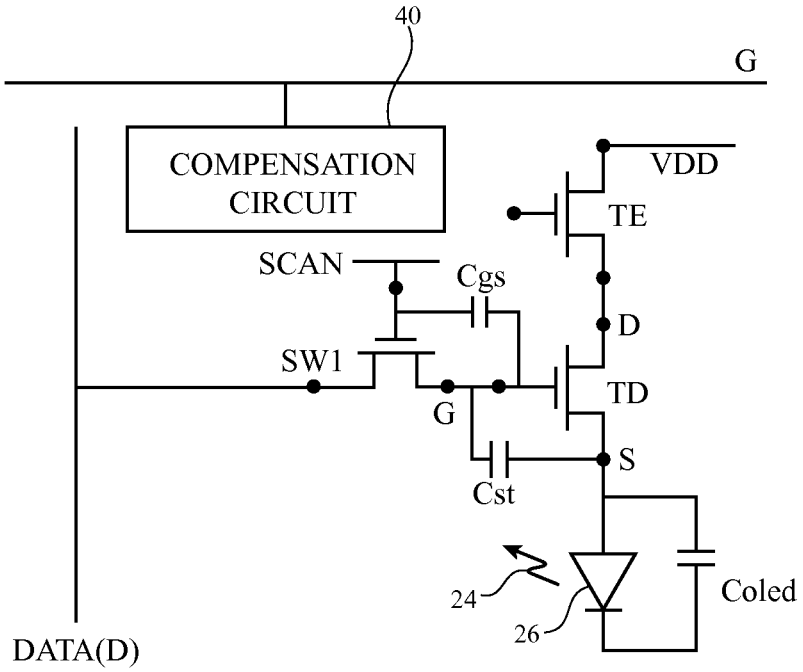
FIG. 3 is a circuit diagram of an illustrative pixel circuit for a display in accordance with an embodiment.

An illustrative pixel circuit for one of pixels 22 is shown in FIG. 3. Pixel circuit 22 of FIG. 3 includes a drive transistor such as drive transistor TD that is coupled in series with light-emitting diode 26. Transistor TD controls that amount of current that flows through diode 26 and therefore the amount of light 24 that is produced by pixel 22. Emission enable transistor TE may be turned off when it is desired to temporarily disable current flow through diode 26 (e.g., during a pre-emission phase in which diode 26 does not emit light) and may be turned on to enable current to flow through drive transistor TD and light-emitting diode 26 (e.g., during an emission phase of operation in which light-emitting diode 26 emits light).

Switching transistors in pixel circuit such as switching transistor SW1 may be used in performing control operations. These operations may include, for example, initialization operations, drive transistor threshold voltage compensation operations (e.g., sample-and-hold operations performed in conjunction with additional circuitry such as compensation circuitry 30 to remove the impact of variations in the threshold voltage of transistor TD), and data loading operations. These operations may be performed before transistor TE is turned on and drive current is applied to diode 26 by drive transistor TD and may therefore sometimes be collectively referred to as "pre-emission operations". Emission operations (i.e., operations in which light 24 is being emitted from diode 26 under control of drive transistor TD) may be performed once the pre-emission operations for pixel 22 have been completed.

There may be 3-8 transistors and 1-2 capacitors in each pixel 22. The transistors are controlled by control signals that allow the transistors to perform desired pre-emission operations and, during emission, that allow drive transistor TD to apply a desired drive current to diode 26. The operations that are performed during the pre-emission phase compensate for variations in drive transistor characteristics such as threshold voltage and mobility and thereby ensure that currents are applied to diodes 26 that are uniform as a function of position across display 14 and as a function of time. The capacitors (see, e.g., capacitors Cst of FIG. 3) of pixel circuit 22 may be used for data storage.

As shown in FIG. 3, one of the source-drain terminals of switching transistor SW1 is coupled to gate G of drive transistor TD. A capacitance Cgs may be present between the gate of switching transistor SW1 and the source-drain terminal of switching transistor SW1 that is coupled to the gate of drive transistor TD. Although transistor SW1 is shown as being coupled between data line DATA (D) and gate G of transistor TD in the example of FIG. 3, this is merely illustrative. Switching transistor SW1 may be connected in other configurations, if desired. As an example, switching transistor SW1 may have a first source-drain terminal coupled to drain (source-drain) D of transistor TD and a second source-drain terminal couple to gate G of transistor TD.

Figure 4:
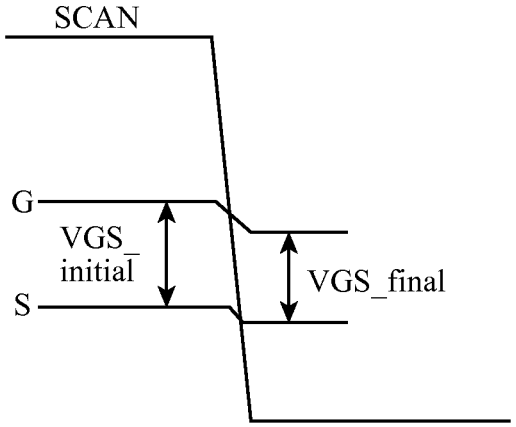
FIG. 4 is a diagram illustrating how abrupt scan signal transitions may introduce gate-source voltage variations in a switching transistor.

A control signal SCAN (sometimes referred to as a gate signal, scan signal, or gate line control signal) is applied to the gate of transistor SW1. At the end of the pre-emission phase (i.e., when transitioning between pre-emission operations and emission operations), the signal SCAN is taken from a first voltage to a second voltage (i.e., SCAN is deasserted). This scan disable transition introduces dynamic effects such as clock feedthrough and charge injection for transistor SW1 that reduce the voltage at gate G of transistor TD, as illustrated in the graph of FIG. 4. As shown in FIG. 4, the gate-source voltage Vgs for transistor TD is perturbed when the signal SCAN is deasserted due to dynamic effects (even though ideally Vgs would be unaffected). This reduces drive current through transistor TD and peak brightness. Because charge injection is dependent on the characteristics of transistor SW1 such as threshold voltage, width, length, etc., the presence of charge injection effects can make display 14 sensitive to variations in the characteristics of transistor SW1. The drive transistor threshold voltage compensation circuitry of pixel 22 can compensate for threshold voltage variations for drive transistor TD, but not for transistor SW1.

By modulating the signal SCAN (e.g., by increasing the pulse width of SCAN and/or by implementing SCAN using a multistep signal transition profile such as a two-step transition profile or other suitable extended signal shape when SCAN is transitioning between an initial voltage and final voltage in connection with a transition between the pre-emission phase and emission phase), current (brightness) range may be increased and the sensitivity of the current of diode 26 to variations in the characteristics of transistor SW1 can be reduced. This approach to enhancing display performance may be used in connection with any type of transistors SW1 (e.g. low-temperature polysilicon, semiconducting oxides, organic semiconductors, etc.) and may apply to both n-type and (with a polarity change) p-type transistors SW1.

If the deassertion of SCAN is too abrupt (i.e., if the transition of SCAN prior to the emission phase is too steep—e.g., if SCAN changes from its initial to final voltage in less than 0.5 microseconds or other short period), the entire voltage swing in the SCAN signal (e.g., its initial voltage VH to its final voltage VL) will impact clock feed-through and charge injection effects. If, however, the SCAN signal's slope is increased (e.g., by extending the transition duration of SCAN to 2-7 microseconds or other suitable value), the period during which the SCAN voltage is at least one threshold voltage VT more than the voltage at gate G of transistor TD will be extended. As a result, the period during which transistor SW1 operates as a closed switch will be extended. During this extended period, which lasts until the SCAN signal falls to a voltage VA=Vg+VT, switch SW1 will operate as a closed switch that couples the voltage at a first of its source-drain terminals that is not connected to gate G to the second of its terminals that is connected to gate G.

Figure 5:
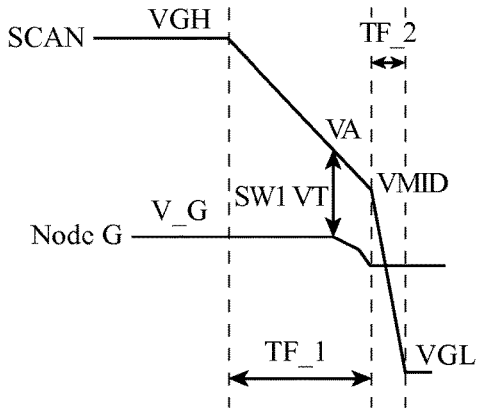
FIGS. 5, 6, 7, and 8 are graphs of illustrative scan signals that may be produced by display driver circuitry when operating an organic light-emitting diode display in accordance with various embodiments.

In the illustrative arrangement of FIG. 5, signal SCAN has a two-step profile. With this scenario, SCAN has a first (shallow) slope that extends the time during which transistor SW1 is on followed by a second (less shallow) slope that completes the transition between first voltage VGH and second voltage VGL. With a two-step profile of the type shown in FIG. 5, only a modified swing voltage of VA−VGL will impact the final voltage at gate G of transistor TD. This reduces the impact of dynamic effects, increases current for diode 26, and reduces the sensitivity of light output to variations in the threshold voltage of transistor SW1. The values of VMID, TF_1, and TF2 can be adjusted based on timing considerations, brightness criteria, desired black settings, etc. With one illustrative arrangement, TF1 is 2-7 microseconds and TF2 is less than 5 microseconds. Other configurations may be used if desired (e.g., TF1 may be more than 1 microsecond, more than 2 microseconds, less than 7 microseconds, 3-7 microseconds, etc. and TF2 may be less than 4 microseconds, more than 0.5 microseconds, etc.)

Figure 6:
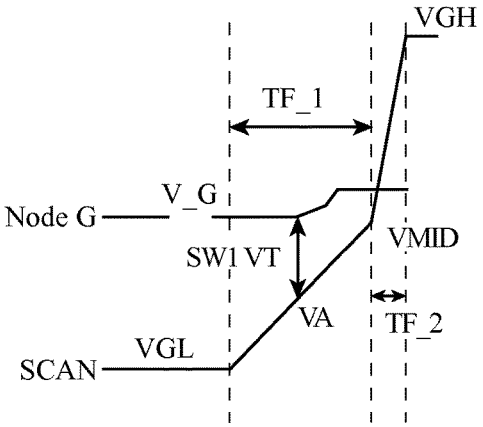
Figure 7:
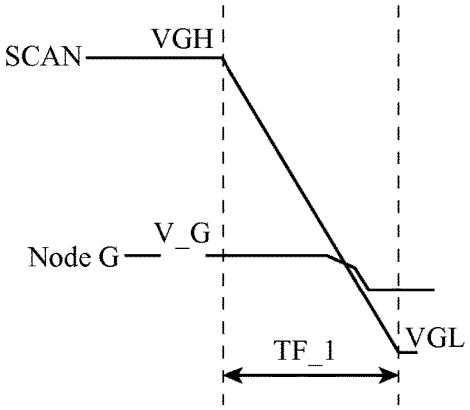
Figure 8:
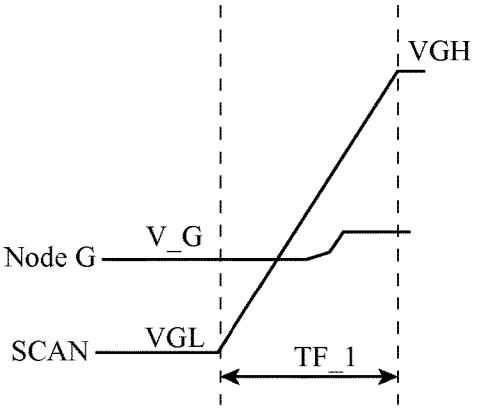

The two-step profile of FIG. 5 is appropriate for controlling transistors SW1 that are formed from n-type thin-film transistor structures. FIG. 6 shows how the polarity of the two-step SCAN pulse may be inverted to control switching transistors SW1 that are formed from p-type thin-film transistor structures. The examples of FIG. 7 (n-type) and FIG. 8 (p-type), show how a lengthened SCAN transition with a one-step profile may be used to control switching transistors SW1. The duration of the SCAN transitions of FIGS. 7 and 8 may be 2-7 microseconds or other suitable duration (e.g., more than 2 microseconds, more than 4 microseconds, less than 7 microseconds, 3-7 microseconds, etc.) may be used.

If desired, display driver circuitry 30 and/or 34 of FIG. 2 may produce SCAN signals with different profiles (e.g., three-step profiles and/or other modulated pulse shapes that reduce the impact of dynamic effects such as clock feedthrough and charge injection). The signals produced by the display driver circuitry that are shown in FIGS. 5, 6, 7, and 8 are merely illustrative.

Figure 9:
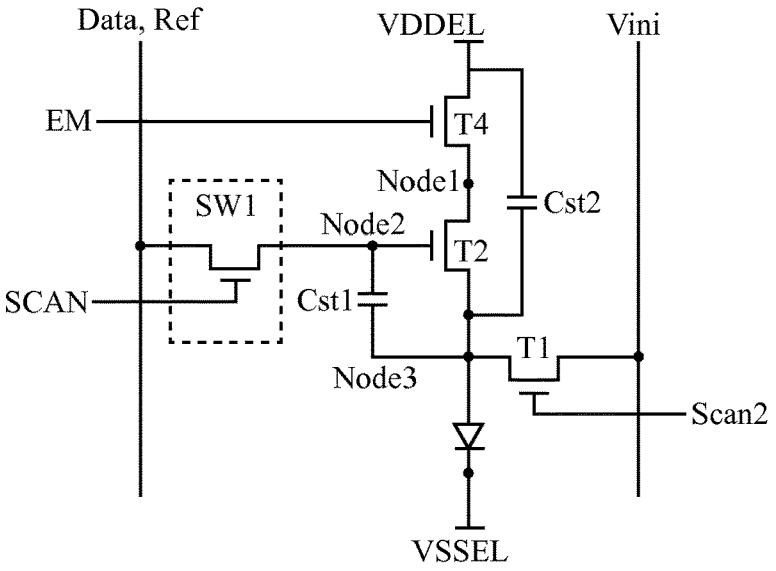
FIGS. 9, 10, 11, and 12 are circuit diagrams of illustrative pixel circuits for an organic light-emitting diode display in accordance with various embodiments.
Figure 10:
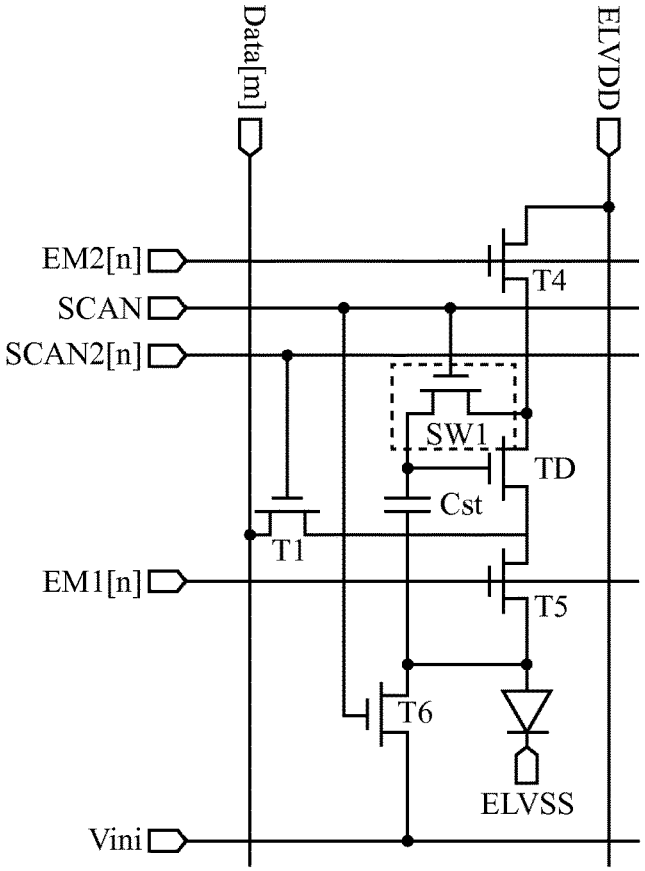
Figure 11:
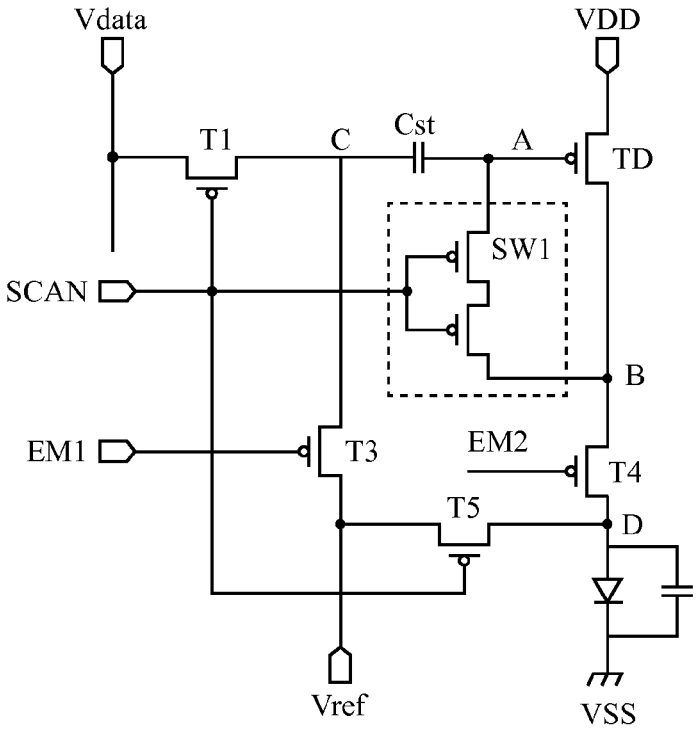
Figure 12:
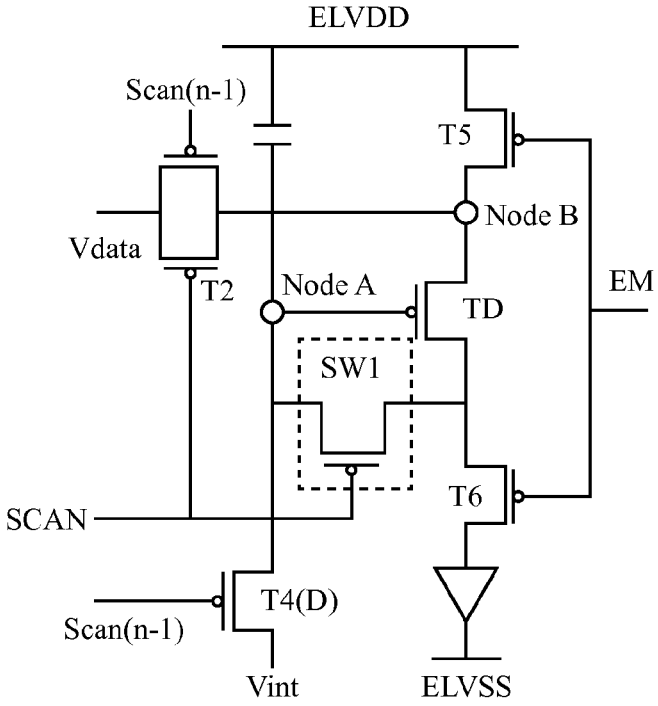

Illustrative configurations for pixel circuit 22 are shown in FIGS. 9, 10, 11, and 12. These pixel circuits each include a switching transistor SW1 having a source-drain terminal coupled to the gate G of drive transistor TD. Pixel circuit 22 of FIG. 9 is an n-type four-transistor-two-capacitor (4T2C) design. Pixel circuit 22 of FIG. 10 is an n-type six-transistor-one-capacitor (6T1C) design. P-type circuits are shown in FIGS. 11 and 12. FIG. 11 is a six-transistor-one-capacitor (6T1C) design formed using p-type transistors. FIG. 12 shows how pixel circuit 22 may be formed from p-type transistors in a seven-transistor-one-capacitor (7T1C) design. Other arrangements may be used for the circuitry of pixels 22 if desired. The circuits of FIGS. 9, 10 11, and 12 are merely examples.

The foregoing is merely illustrative and various modifications can be made by those skilled in the art without departing from the scope and spirit of the described embodiments. The foregoing embodiments may be implemented individually or in any combination.

What is claimed is:

1. A display, comprising:

a pixel array having rows and columns of pixels each having a light-emitting diode and a drive transistor coupled in series with the light-emitting diode, wherein the drive transistor has a drive transistor gate terminal;

display driver circuitry that conveys data to the pixels via data lines and that supplies control signals to the pixels via control lines, wherein the control signals include a scan signal with a multistep transition profile; and a switching transistor in each pixel having a source-drain terminal coupled to the drive transistor gate terminal and having a switching transistor gate terminal that receives the scan signal with the multistep transition profile, wherein the multistep transition profile is characterized by a first portion in which the scan signal has a first slope and a first duration and a second portion in which the scan signal has a second slope and a second duration, and wherein, during the first portion, the scan signal falls below a voltage level that is equal to the sum of a voltage at the drive transistor gate terminal and a threshold voltage of the switching transistor.

2. The display defined in claim 1 wherein the display driver circuitry supplies the control signals to each of the pixels during a pre-emission phase in which the light-emitting diode of the pixel does not emit light and during an emission phase in which the light-emitting diode of the pixel emits light and wherein the scan signal has the multistep transition profile during a transition from a first voltage to a second voltage when transitioning between the pre-emission phase and the emission phase.

3. The display defined in claim 2 wherein the first slope is shallower than the second slope.

4. The display defined in claim 3 wherein the first duration is greater than 1 microsecond.

5. The display defined in claim 4 wherein the first duration is greater than 2 microseconds.

6. The display defined in claim 5 wherein the first duration is 2-7 microseconds.

7. The display defined in claim 6 wherein the second duration is less than 2 microseconds.

8. The display defined in claim 7 wherein each pixel has four transistors including the switching transistor and the drive transistor.

9. The display defined in claim 8 wherein each pixel has two capacitors.

10. The display defined in claim 7 wherein each pixel has six transistors including the switching transistor and the drive transistor.

11. The display defined in claim 10 wherein each pixel has one capacitor.

12. The display defined in claim 7 wherein each pixel has seven transistors including the switching transistor and the drive transistor.

13. The display defined in claim 12 wherein each pixel has one capacitor.

14. The display defined in claim 7 wherein the switching transistor and the drive transistor are p-type transistors.

15. The display defined in claim 7 wherein the switching transistor and the drive transistor are n-type transistors.

16. A display, comprising:

a pixel array having rows and columns of pixels each having a light-emitting diode and a drive transistor coupled in series with the light-emitting diode, wherein the drive transistor has a drive transistor gate terminal;

display driver circuitry that conveys data to the pixels via data lines and that supplies control signals to the pixels via control lines, wherein the control signals include a scan signal; and a switching transistor in each pixel having a source-drain terminal coupled to the drive transistor gate terminal and having a switching transistor gate terminal that receives the scan signal, wherein the display driver circuitry supplies the scan signal to each of the pixels during a pre-emission phase in which the light-emitting diode of the pixel does not emit light and during an emission phase in which the light-emitting diode of the pixel emits light and wherein the scan signal has a fall time or rise time of 2-7 microseconds when transitioning between the pre-emission phase and the emission phase.

17. The display defined in claim 16 wherein each pixel has at least four transistors including the switching transistor and the drive transistor.

18. The display defined in claim 17 wherein each pixel has at least one capacitor.

19. The display defined in claim 16 wherein each pixel has at least six transistors.

20. The display defined in claim 19 wherein each pixel has at least two capacitors.

21. The display defined in claim 16 wherein each pixel has at least seven transistors.

22. A display, comprising:

a pixel array having rows and columns of pixels each having a light-emitting diode and a drive transistor coupled in series with the light-emitting diode, wherein the drive transistor has a drive transistor gate terminal;

display driver circuitry that conveys data to the pixels via data lines and that supplies control signals to the pixels via control lines, wherein the control signals include a scan signal; and a switching transistor in each pixel having a source-drain terminal coupled to the drive transistor gate terminal and having a switching transistor gate terminal that receives the scan signal, wherein the scan signal has a first slope for a first period and second slope that is steeper than the first slope for a second period following the first period when transitioning between a first voltage and a second voltage prior to entering an emission phase in which the light-emitting diode of that pixel emits light, and wherein the switching transistor switches during the first period.

23. The display defined in claim 22 wherein the first period and the second period are collectively 2-7 microseconds in duration.

* * * * *